US010364953B2

(12) United States Patent
Cohen

(10) Patent No.: US 10,364,953 B2
(45) Date of Patent: Jul. 30, 2019

(54) SOLAR-POWERED LANTERN WITH SIMULATED EDISON BULB

(71) Applicant: Richard Cohen, Ann Arbor, MI (US)

(72) Inventor: Richard Cohen, Ann Arbor, MI (US)

( * ) Notice: Subject to any disclaimer, the term of this patent is extended or adjusted under 35 U.S.C. 154(b) by 0 days.

(21) Appl. No.: 15/805,222

(22) Filed: Nov. 7, 2017

(65) Prior Publication Data

US 2018/0187846 A1 Jul. 5, 2018

Related U.S. Application Data

(60) Provisional application No. 62/418,708, filed on Nov. 7, 2016.

(51) Int. Cl.

| | |
|---|---|
| ***F21S 9/03*** | (2006.01) |
| ***F21V 21/08*** | (2006.01) |
| ***F21K 9/232*** | (2016.01) |
| ***F21V 11/00*** | (2015.01) |
| ***F21V 21/30*** | (2006.01) |
| ***F21V 23/04*** | (2006.01) |
| ***F21K 9/237*** | (2016.01) |
| *F21Y 115/10* | (2016.01) |

(52) U.S. Cl.

CPC ..... *F21S 9/037* (2013.01); *F21K 9/232* (2016.08); *F21K 9/237* (2016.08); *F21V 11/00* (2013.01); *F21V 21/08* (2013.01); *F21V 21/30* (2013.01); *F21V 23/0464* (2013.01); *F21Y 2115/10* (2016.08)

(58) Field of Classification Search

CPC .. F21S 9/037; F21S 9/03; F21K 9/232; F21K 9/237; F21V 11/00; F21V 21/08; F21V 21/30; F21V 23/0464; F21V 15/02; F21V 23/00; F21V 1/00; F21Y 2115/10; F21L 4/08

USPC ..... 362/183

See application file for complete search history.

(56) References Cited

U.S. PATENT DOCUMENTS

| | | | | |
|---|---|---|---|---|
| 1,471,194 | A * | 10/1923 | Nordman | B61L 5/18 246/488 |
| 2005/0213216 | A1* | 9/2005 | May | F21L 19/00 359/612 |
| 2005/0254232 | A1* | 11/2005 | Bentley | F21S 6/001 362/161 |
| 2007/0274066 | A1* | 11/2007 | Lodhie | F21L 4/00 362/183 |
| 2011/0032695 | A1* | 2/2011 | Cumberland | F21S 8/036 362/183 |

(Continued)

*Primary Examiner* — Bao Q Truong

(74) *Attorney, Agent, or Firm* — John G. Posa; Belzer PC

(57) ABSTRACT

A solar-powered lantern uses light-emitting diodes to simulate an old-fashioned Edison-type bulb. The lantern comprises a housing having an upper edge defining an upper surface, a lower edge defining a lower surface, and a sidewall between the upper and lower edges. The lower edge of the housing transitions into a shade portion that extends downwardly from the housing. In the preferred embodiment the housing is cylindrical, and the shade is a conical shade having an upper edge coinciding with the lower edge of the housing. A light bulb also extends downwardly from the lower surface of the housing, and the light bulb is surrounded by a cage. A solar panel is disposed on the upper surface of the housing. A rechargeable battery is disposed in the housing, and the rechargeable battery is recharged with electrical energy generated by the solar panel.

11 Claims, 4 Drawing Sheets

(56) References Cited

U.S. PATENT DOCUMENTS

| | | | | |
|---|---|---|---|---|
| 2014/0049942 | A1* | 2/2014 | Chilton | F21L 4/00 362/96 |
| 2015/0192260 | A1* | 7/2015 | Muehlemann | F21L 4/08 362/101 |
| 2018/0172252 | A1* | 6/2018 | Maguire | F21L 4/08 |
| 2018/0209594 | A1* | 7/2018 | Parisi | F21L 4/00 |

* cited by examiner

SOLAR-POWERED LANTERN WITH SIMULATED EDISON BULB

REFERENCE TO RELATED APPLICATIONS

This application claims priority to U.S. Provisional Patent Application Ser. No. 62/418,708, filed Nov. 7, 2016, the entire content of which is incorporated herein by reference.

FIELD OF THE INVENTION

This invention relates generally to hanging lanterns and, in particular, to a vintage-appearing hanging lantern that includes a simulated Edison bulb composed of light-emitting diodes (LEDs).

BACKGROUND OF THE INVENTION

There are many types of outdoor lamps for different applications. It would be advantageous to provide an energy-efficient, solar-powered lantern with an LED-based light source.

SUMMARY OF THE INVENTION

This invention resides in a solar-powered lantern that uses light-emitting diodes to simulate an old-fashioned Edison-type bulb. The lantern comprises a housing having an upper edge defining an upper surface, a lower edge defining a lower surface, and a sidewall between the upper and lower edges. The lower edge of the housing transitions into a shade portion that extends downwardly from the housing. In the preferred embodiment the housing is cylindrical, and the shade is a conical shade having an upper edge coinciding with the lower edge of the housing.

A light bulb also extends downwardly from the lower surface of the housing, and the light bulb is surrounded by a cage. The cage may include a lower portion with a connector adapted for coupling to a vertical support rod. A hanger may also be provided with two ends coupled to opposing sidewalls of the housing. A solar panel is disposed on the upper surface of the housing. A rechargeable battery is disposed in the housing, and the rechargeable battery is recharged with electrical energy generated by the solar panel. The light bulb is a simulated Edison bulb including an outer transparent or translucent shell encapsulating at least one elongated simulated filament defined by a plurality of LEDs powered by the rechargeable battery.

In the preferred embodiment the LEDs produce light that is yellowish in color, and the housing, shade and cage are all metallic. The lantern may further include a light sensor, such that the battery charges during the day and the LEDs do not light up until a predetermined level of dusk or darkness is achieved. The light sensor may be a separate device, or the solar panel itself may be used as a light sensor.

DETAILED DESCRIPTION OF THE INVENTION

Figure 1:
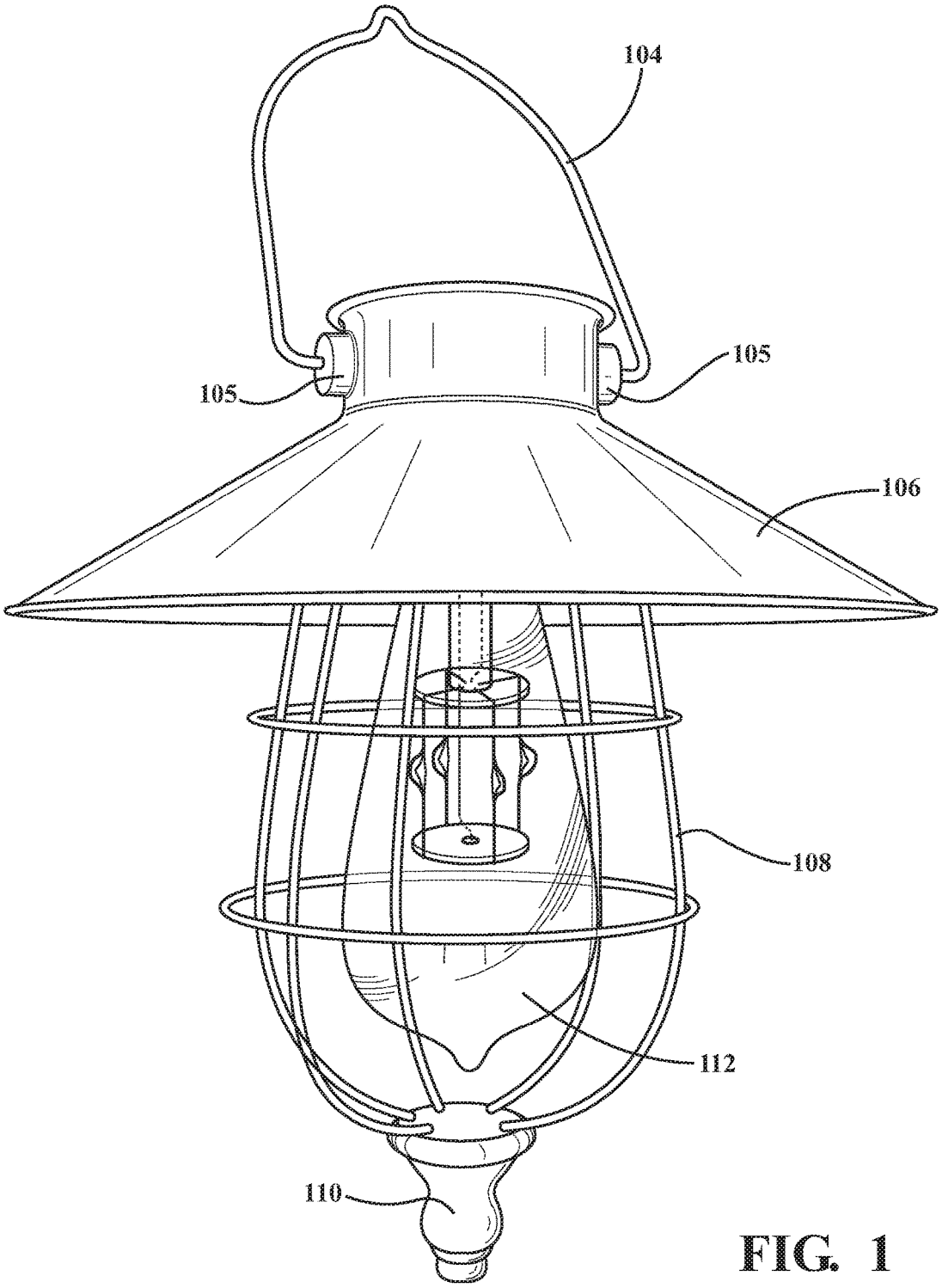
FIG. 1 depicts a preferred embodiment of the invention.

FIG. 1 depicts a preferred embodiment of the invention. The invention includes a housing 102 coupled to a shade portion 106. These aspects are preferably stamped metal. For suspending the article, a hanger 104 attaches to both sides of the housing at 105. Under shade 106 a bulb 112 is coupled to the bottom of the housing. An optional decorative cage 108 surrounds the bulb 112. The bottom of the cage terminates in a fitting 110 adapted to receive a vertical rod (not shown) for upright ground support.

Figure 2:
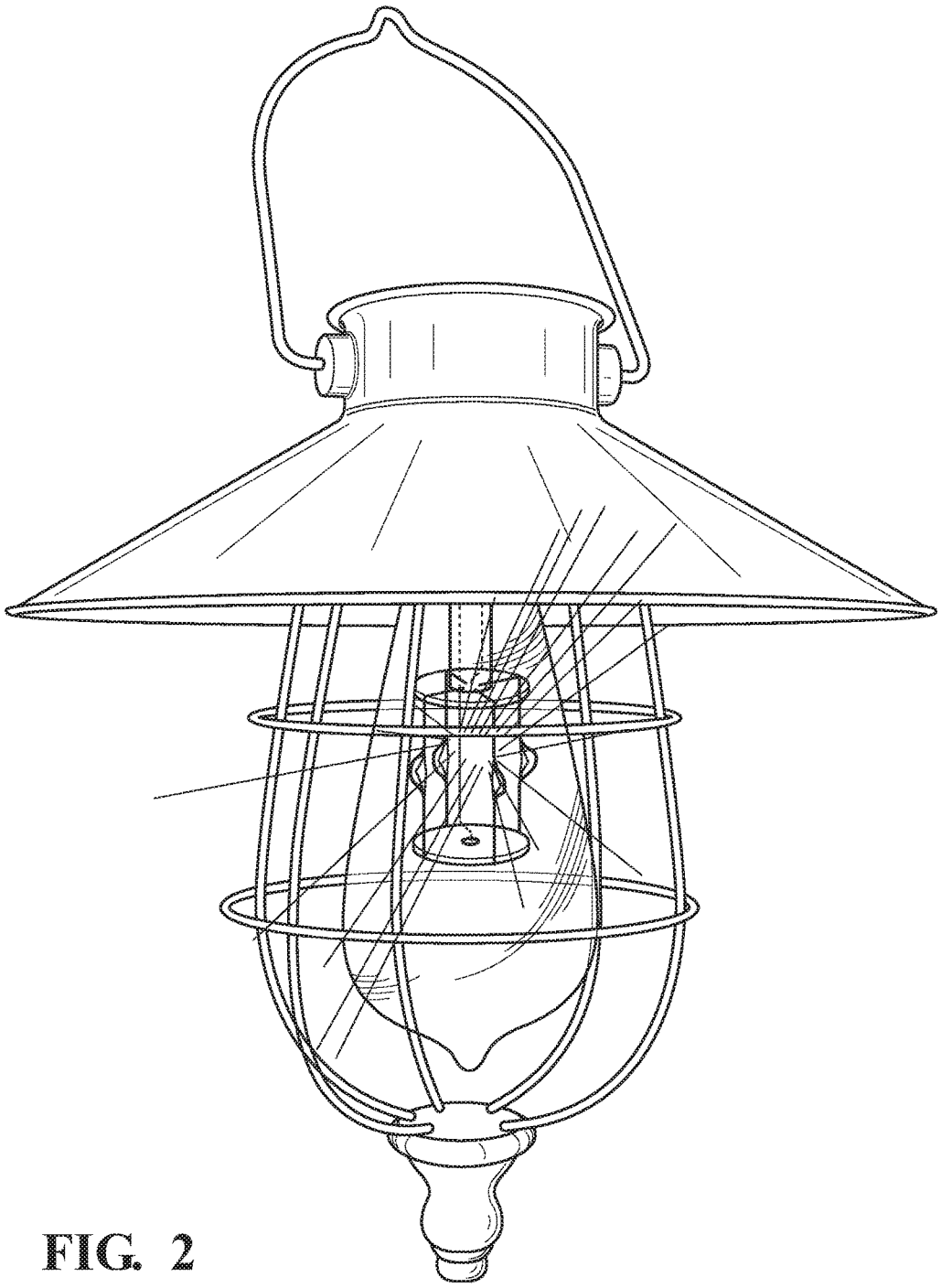
FIG. 2 shows the article with the LEDs activated.
Figure 3:
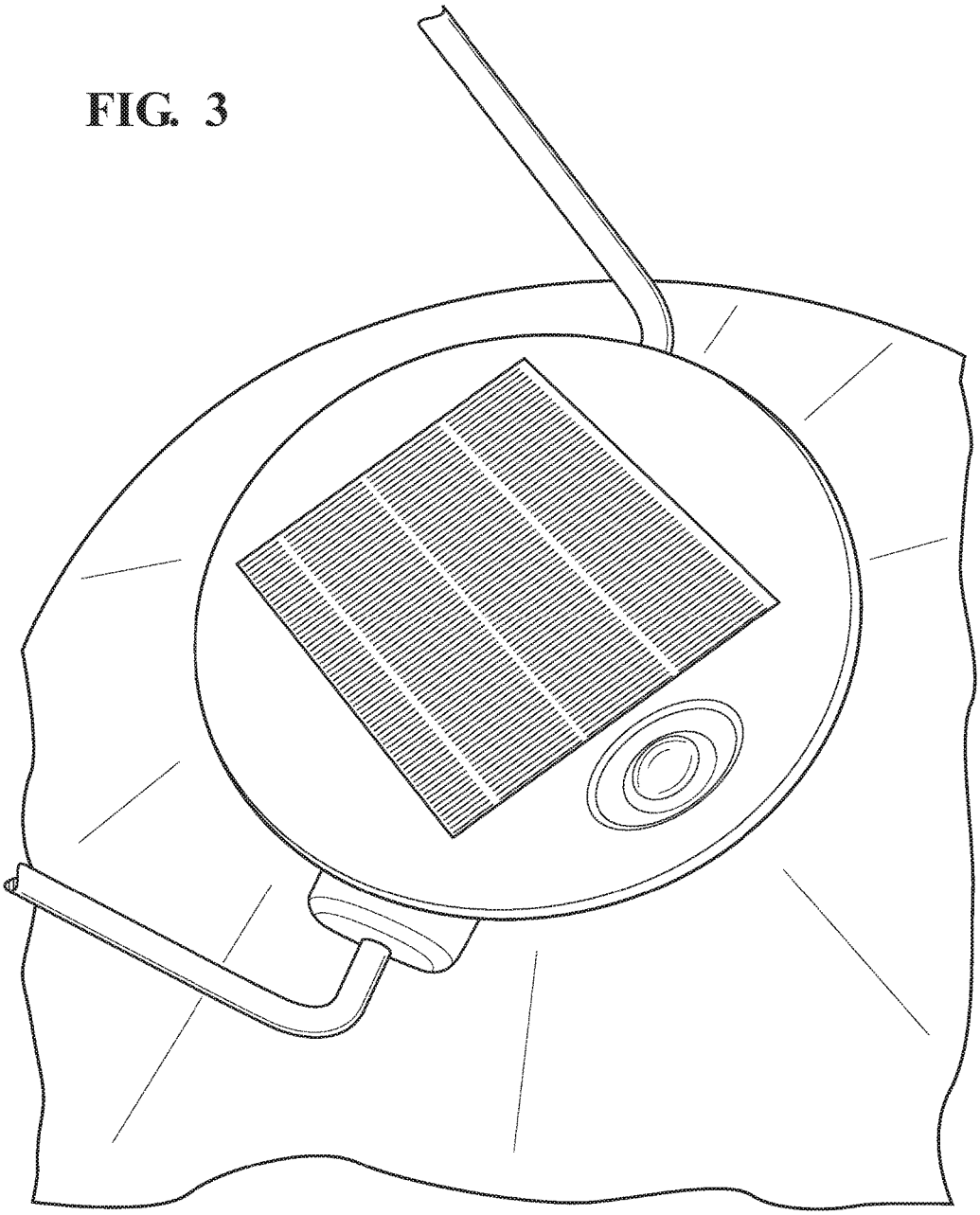
FIG. 3 is a top view of the lantern, showing the solar cell and ON/OFF switch.

The simulated bulb uses light-emitting diodes as described in further detail below. FIG. 2 shows the article with the LEDs activated. FIG. 3 is a top view of the lantern, showing the solar cell 200 and ON/OFF switch 202.

Figure 4:
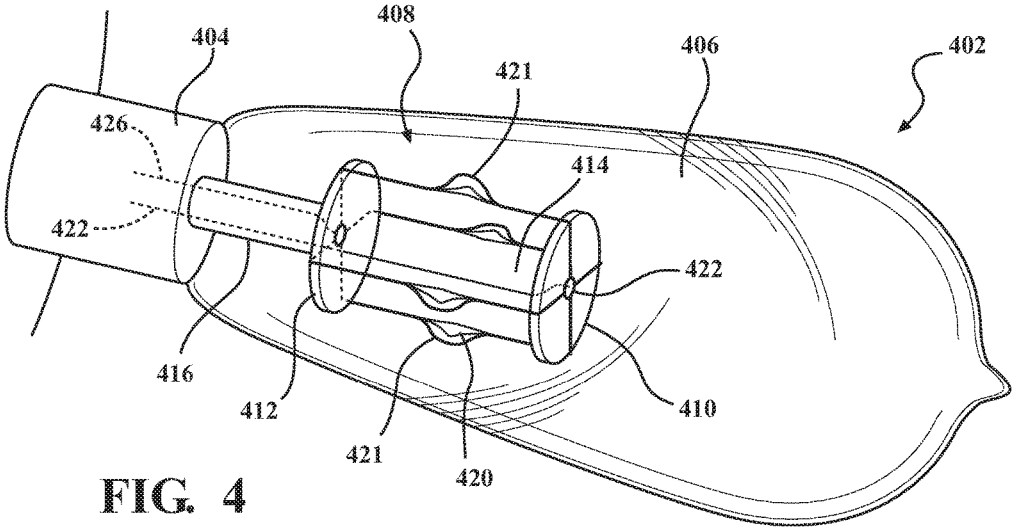
FIG. 4 is a detail view of the simulated Edison bulb.

FIG. 4 is a detail view of the simulated Edison bulb 402. The bulb includes an outer transparent shell 406 made of glass or plastic attached to a base 404. A stem assembly 408 within the shell 406 includes a distal disc 410 separated from a proximal disk 412 separated by a tube 414. The proximal disc is mounted to the base 404 via a hollow tube 416. The discs and tubes are preferably also made of a clear glass or plastic to simulate the inner portions of a vintage Edison bulb.

A plurality of LEDs 420 are supported between the spaced-apart discs, with one lead of each being connected at point 422, and the other ends of the LEDs being connected to lead 426. Thus, the LEDs are preferably connected in parallel, with the leads 422, 426 being routed out and through the base 404 for interconnection to the circuit shown in FIG. 5. To enhance the simulation, each LED is potted with a glob of translucent material such as silicone or the like to appear as a "filament." Further, yellowish LEDs are preferably used as opposed to high-brightness or white LEDs to simulate incandescence.

Figure 5:
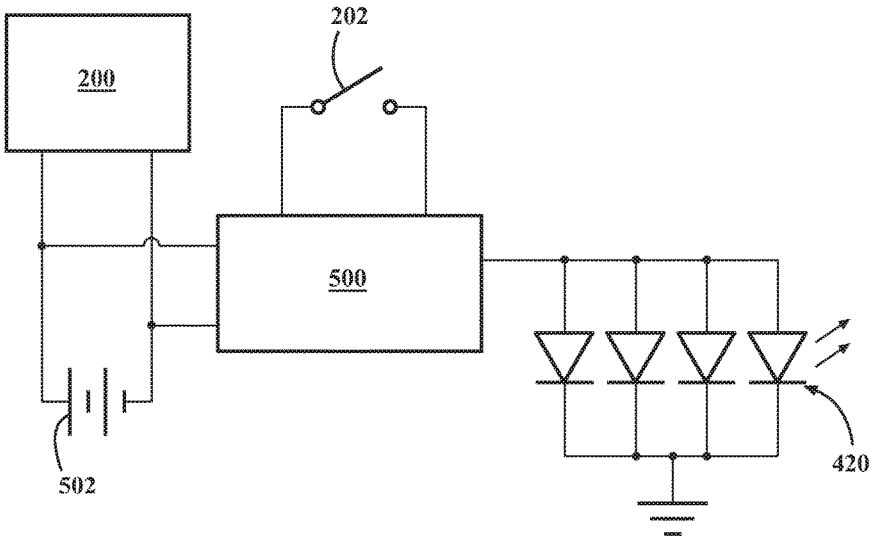
FIG. 5 is a block diagram of the electronics contained in the housing.

FIG. 5 is a block diagram of the electronics contained in the housing. Solar panel 200 charges a rechargeable battery 502 that provides power to microcontroller 500. Microcontroller 500 provides power to LEDs 420. An optional ON/OFF switch 202 may be provided. In the preferred embodiment, a light sensor is included such that the battery charges during the day and the LEDs do not light up until a predetermined level of dusk or darkness is achieved. Either an optional photocell may be used as a light sensor or, more preferably, solar cell 200 may be used.

The invention claimed is:

1. A solar-powered lantern, comprising:

a housing having an upper edge defining an upper surface, a lower edge defining a lower surface, and a sidewall between the upper and lower edges;

wherein the lower edge of the housing transitions into a shade portion extending downwardly and outwardly from the sidewall of the housing;

a light bulb extending downwardly from the lower surface of the housing;

a cage extending downwardly from the housing and surrounding the light bulb;

a hanger having two ends coupled to opposing regions on the sidewall of the housing;

a solar panel disposed on the upper surface of the housing;

a rechargeable battery disposed in the housing, and wherein the rechargeable battery is recharged with electrical energy generated by the solar panel;

wherein the light bulb is a simulated Edison bulb including an outer transparent shell encapsulating an elongated simulated filament defined by a plurality of LEDs powered by the rechargeable battery; and wherein the solar-powered lantern is entirely self-contained and portable, utilizing no power source other than the rechargeable battery for powering the LEDs in the simulated Edison bulb.

2. The solar-powered lantern of claim 1, wherein:

the housing is cylindrical; and the shade is a conical shade having an upper edge coinciding with the lower edge of the housing and a lower edge that extends beyond the cylindrical housing.

3. The solar-powered lantern of claim 1, wherein the ends of the hanger a pivotally coupled to the sidewalls of the housing.

4. The solar-powered lantern of claim 1, wherein the cage is comprised of intersecting horizontal and vertical elements with gaps therebetween.

5. The solar-powered lantern of claim 1, wherein the cage includes a lower portion with a connector adapted for coupling to a vertical support.

6. The lantern if claim 1, wherein the LEDs are yellowish in color.

7. The lantern if claim 1, wherein the housing and shade are metallic.

8. The lantern if claim 1, wherein the cage is metallic.

9. The lantern if claim 1, further including a light sensor such that the battery charges during the day and the LEDs do not light up until a predetermined level of dusk or darkness is achieved.

10. The lantern if claim 9, wherein the light sensor is a separate device or the solar panel is used as a light sensor.

11. The solar-powered lantern of claim 4, wherein the vertical elements comprise a plurality of continuous rings that surround the simulated Edison bulb.

* * * * *